US006164773A

United States Patent [19]

Oikawa

[11] Patent Number: 6,164,773

[45] **Date of Patent: *Dec. 26, 2000**

[54] INK-JET PRINTING APPARATUS AND PRINTING METHOD USING INK IMPROVING LIQUID

[75] Inventor: Masaki Oikawa, Kodaira, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/921,526

[22] Filed: Sep. 2, 1997

[30] Foreign Application Priority Data

Sep. 3, 1996 [JP] Japan ..... 8-232800

[51] Int. Cl.[7] ..... B41J 2/01

[52] U.S. Cl. ..... 347/100; 347/101

[58] Field of Search ..... 347/100, 20, 21, 347/41, 9, 12, 15, 43, 14, 95, 101

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,520,374 | 5/1985 | Koto | 347/48 |
| 4,538,160 | 8/1985 | Uchiyama | 347/101 |
| 4,558,333 | 12/1985 | Sugitani et al. | 347/65 |
| 4,599,627 | 7/1986 | Vollert | 347/101 X |
| 4,608,577 | 8/1986 | Hori | 347/66 |
| 4,630,076 | 12/1986 | Yoshimura | 347/43 |
| 4,723,129 | 2/1988 | Endo et al. | 347/56 |
| 4,740,796 | 4/1988 | Endo et al. | 347/56 |
| 5,159,354 | 10/1992 | Hirasawa et al. | 347/65 |
| 5,805,190 | 9/1998 | Tsuchii et al. | 347/100 |

FOREIGN PATENT DOCUMENTS

| | | |
|---|---|---|
| 0 671 268 | 9/1995 | European Pat. Off. . |
| 0 675 179 | 10/1995 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |
| 1-63185 | 3/1989 | Japan . |

*Primary Examiner*—Arthur T. Grimley
*Assistant Examiner*—Hoan Tran
*Attorney, Agent, or Firm*—Fitzpatirck, Cella, Harper & Scinto

[57] ABSTRACT

A printing apparatus has an ink-jet printing head having one nozzle array for ejecting an ink, and the other nozzle array for ejecting a printing improvement liquid containing a substance making a coloring agent in the ink insoluble or coagulate. When the printing improvement liquid is ejected in advance of ejection of the ink, the ejection speed of the ink is set to be lower than the ejection speed of the printing improvement liquid. When the ink is ejected in advance of ejection of the printing improvement liquid, the ejection speed of the printing improvement liquid is set to be lower than the ejection speed of the ink. The printing apparatus is capable of preventing ejection failure or deflection of the ejecting direction due to rebounding of the printing improvement liquid or mist thereof.

20 Claims, 10 Drawing Sheets

INK-JET PRINTING APPARATUS AND PRINTING METHOD USING INK IMPROVING LIQUID

BACKGROUND OF THE INVENTION

1. Field of the Invention

The present invention relates generally to an ink-jet printing apparatus and a printing method, and more specifically to an ink-jet printing apparatus achieving high stability in ink ejection for performing high quality printing by ejecting an ink and a liquid containing a substance which makes coloring agent in the ink insoluble or aggregation.

2. Description of the Related Art

Conventionally, there has been proposed an ink-jet printing apparatus performing printing by ejecting an ink toward a printing medium through ejection openings in an ink-jet head by applying heat for the ink by means of a heater to generate bubble in the ink and utilizing a pressure generated by expansion of the bubble.

Recently, for printing a high quality image, it has been proposed to eject a particular liquid onto the printing medium immediately before or immediately after ejecting the ink. The liquid is a transparent and colorless liquid to be mixed with the ink. The liquid and the ink overlapped on the printing medium are admixed on the printing medium before they are absorbed into the printing medium and fixed thereon. In such manner, printing characteristics such as color development ability, water resistance and bleeding prevention ability of the ink in relation to the printing medium can be improved. Particularly, even when the printing medium is a general plain paper, on which an ink receptacle layer is not coated, the liquid demonstrates substantial effect in permitting printing without causing bleeding. Such liquids are called printing improvement liquids.

In the prior art, a problem has been encountered in degradation of quality of a printed image due to bleeding of ink caused by fibers of the paper when printing is performed by ink-jet system on a general plain paper having no coated ink receptacle layer. Such problem is about to be solved by the printing method employing the foregoing printing improvement liquid. For this purpose, various printing improvement liquids have been developed.

All of the printing improvement liquids to be employed for the purpose set forth above have a property to make a coloring agent in the ink insoluble or aggregated, and thus instantly fixed once it is admixed with the ink. Therefore, when the droplet of the printing improvement liquid rebounded from the surface of the plain paper or mist thereof contacts with a face of an ejection head, the printing improvement liquid can be fixed on the face to cause a problem of blocking of ink ejection openings.

Next, the foregoing problem will be specifically explained with reference to the drawings.

FIGS. 3A and 3B are front elevation views showing constructions of ink-jet printing heads, in each of which a nozzle array for ejecting ink and a nozzle array for ejecting printing improvement liquid are arranged in parallel relationship on a common face. FIG. 3A shows a face of a black ink head 2, in which the nozzle array for ejecting a Bk (black) ink and the nozzle array for ejecting the printing improvement liquid are arranged in combination. FIG. 3B shows a face of a color ink head 3, in which the nozzle arrays for ejecting inks of respective colors of Y (yellow), M (magenta) and C (cyan) and the nozzle arrays for ejecting printing improvement liquids are arranged in combination.

As shown in FIG. 3B, the nozzle arrays for respective colors of inks in the color ink head 3 are aligned with the corresponding nozzle arrays of the printing improvement liquids in parallel relationship. Adjacent nozzle arrays are spaced away from each other with a predetermined distance therebetween. Both of black ink head 2 shown in FIG. 3A and the color ink head 3 shown in FIG. 3B are scanned in a direction of arrows 6 and 7 by means of not shown carriages. The respective nozzle arrays are arranged in directions perpendicular to the scanning direction. When the nozzle arrays are scanned in the direction of arrow 6, the printing improvement liquids are ejected toward the printing paper as the printing medium in advance of ejection of the inks, and when the nozzles are scanned in the direction of arrow 7, the inks are ejected toward the printing paper in advance of the printing improvement liquid.

In the ink-jet printing apparatus, the ink and the printing improvement liquid are ejected at the same region in the scanning direction. Therefore, it is typical to make an ejection speed of the ink and an ejection speed of the printing improvement liquid equal to each other.

FIG. 5 is a side elevation diagrammatically illustrating a condition of deposition of the rebounded droplet of the printing improvement liquid ejected from the ink-jet printing head having the nozzle arrays arranged in parallel as shown in FIGS. 3A and 3B, on the face of the head at the region shifted within a predetermined period. Here, an example where the printing improvement liquid is ejection in advance of ejected of the ink will be explained.

In FIG. 5, the reference numeral 1 denotes an ink-jet printing head (hereinafter referred to as head), and 5 denotes a printing paper as a printing medium. On the printing paper 5, the droplet of the printing improvement liquid is already deposited. Before the printing improvement liquid deposited on the printing paper 5 is absorbed in the latter, the ink droplet D3 is ejected toward a region S3 where the printing improvement liquid droplet is deposited. When the ink droplet D3 is ejected to the region S3 where the printing improvement liquid droplet is deposited, the printing improvement liquid in the region S3 is not yet absorbed in the printing paper 5. Therefore, the rebounding P of the printing improvement liquid can be caused by impact of the ink droplet D3' on the printing paper 5. Among the rebounded droplet P of the printing improvement liquid, some of the rebounded droplet P' may fly toward the face 4 of the head 1. When the head 1 is scanned up to the region of 1', the rebounded droplet P' can deposit on the face 4 of the head as a rebounded droplet P".

The printing improvement liquid deposited on the face 4 of the head may be admixed with the ink droplet deposited on the face 4 as a mist or the ink droplet to be ejected at next ejection timing to cause fixing. In addition to the rebounded droplet, the printing improvement liquid may deposit on the face 4 also as a mist.

The printing improvement liquid thus fixed on the face 4 of the head 1 may cause plugging of the nozzle to result in ejection failure or deflection of the ejecting direction. Also, in case of the printing apparatus having a wiper blade wiping the face 4, damaging of the wiper blade or insufficient wiping can be caused.

SUMMARY OF THE INVENTION

The present invention solves the problems set forth above. Therefore, it is an object of the present invention to provide an ink-jet printing apparatus and a printing method, which may vary ejection speeds of an ink and a printing improvement liquid to reduce rebounding amount of the printing improvement liquid or mist thereof and thus may prevent fixing of the printing improvement liquid to provide stability of ejection.

In a first aspect of the present invention, there is provided an ink-jet printing apparatus for performing a printing employing an ink ejection portion for ejecting an ink toward a printing medium and a liquid ejection portion for ejecting a liquid containing a substance making a coloring agent in the ink insoluble or coagulater, wherein the ink droplet ejected from the ink ejection portion and the liquid droplet ejected from the liquid ejection portion are ejected toward the same region of the printing medium with a slight time lag so that the ink and the liquid are overlapped, and wherein an ejection speed of the later is lower than that of the earlier.

Here, the ink-jet printing apparatus may further comprise a moving means for reciprocally scanning the ink ejection portion and the liquid ejection portion which are parallel to an upper surface of the printing medium.

The ink ejection portion may include a nozzle array extending in a direction perpendicular to a scanning direction of the ink ejection portion defined by the moving means, and wherein the liquid ejection portion may include a nozzle array parallel to the nozzle array of the ink ejection portion.

The ejection of the ink and that of the liquid may be performed at the same region of the printing medium during the same scanning cycle by the moving means so that droplets of the ink and the printing improvement liquid are overlapped at the same region of the printing medium.

The ejection speed v (m/s) of the later-ejected droplet may be within a range of $7<v<13$.

Each of nozzles in the ink ejection portion or the liquid ejection portion may include a single ejection opening for ejecting the ink or the liquid, a pair of electro-thermal transducers being arranged in a passage communicating with the ejection opening, the electro-thermal transducers being different from the distance to the ejection opening. The ejection of the earlier may be performed by utilizing heating of the electro-thermal transducer close to the ejection opening, and the ejection of the later may be performed by utilizing heating of the distant electro-thermal transducer.

The liquid may contain cationic substances having a low molecular component and a high molecular component, and wherein the ink may contain anionic dye.

The liquid may contain cationic substances having a low molecular component and a high molecular component, and wherein the ink may contain anionic compound and pigment.

Each of the electro-thermal transducers of the liquid ejection portion or the ink ejection portion may generate a bubble in the liquid or the ink to eject the droplet of the liquid or the ink by utilizing expansion of the bubble.

In a second aspect of the present invention, there is provided an ink-jet printing method of performing a printing by ejecting an ink and a liquid containing a substance making a coloring agent in the ink insoluble or coagulate, toward a printing medium, comprising the steps of:

providing an ink ejection portion for ejecting the ink and a liquid ejection portion for ejecting the liquid; and ejecting the ink droplet ejected from the ink ejection portion and the liquid droplet ejected from the liquid ejection portion toward the same region of the printing medium with a slight time lag so that the ink and the liquid are overlapped, an ejection speed of the later being lower than that of the earlier.

Here, an ink-jet printing method may further comprise the step of providing a moving means for reciprocally scanning the ink ejection portion and the liquid portion which are parallel to an upper surface of the printing medium.

The provided ink ejection portion may include a nozzle array extending in a direction perpendicular to a scanning direction of the ink ejection portion defined by the moving means, and wherein the liquid ejection portion may include a nozzle array parallel to the nozzle array of the ink ejection portion.

The ejection of the ink and that of the liquid may be performed at the same region of the printing medium during the same scanning cycle by the moving means so that droplets of the ink and the printing improvement liquid are overlapped at the same region of the printing medium.

The ejection speed v (m/s) of the later-ejected droplet may be within a range of $7<v<13$.

Each of nozzles in the ink ejection portion or the liquid ejection portion may include a single ejection opening for ejecting the ink or the liquid, a pair of electro-thermal transducers being arranged in a passage communicating with the ejection opening, the electro-thermal transducers being different from the distance to the ejection opening. The ejection of the earlier may be performed by utilizing heating of the electro-thermal transducer close to the ejection opening, and the ejection of the later may be performed by utilizing heating of the distant electro-thermal transducer.

The liquid may contain cationic substances having a low molecular component and a high molecular component, and wherein the ink may contain anionic dye.

The liquid may contain cationic substances having a low molecular component and a high molecular component, and wherein the ink may contain anionic compound and pigment.

Each of the electro-thermal transducers of the liquid ejection portion or the ink ejection portion may generate a bubble in the liquid or the ink to eject the droplet of the liquid or the ink by utilizing expansion of the bubble.

In the present invention, by lowering ejection speed of the ink or the printing improvement liquid ejected later, impact of the ink droplet or the printing improvement liquid droplet on the printing paper can be lowered to reduce rebounding.

Also, in the present invention, by reducing impact of the ink droplet or the printing improvement liquid droplet on the printing paper, rebounding of the printing improvement liquid or the ink and generation of mist can be reduced.

Furthermore, by lowering the ejection speed of the printing improvement liquid, impact of the printing improvement liquid on the printing paper can be reduced to reduce rebounding and mist, and since the ejection speed of the ink is not lowered, stability of ink ejection can maintained.

In addition, rebounding and mist of the printing improvement liquid can be reduced without lowering of the printing speed for capability of printing in both directions.

The above and other objects, effects, features and advantages of the present invention will become more apparent from the following description of embodiments thereof taken in conjunction with the accompanying drawings.

DESCRIPTION OF THE PREFERRED EMBODIMENT

First Embodiment

Figure 1:
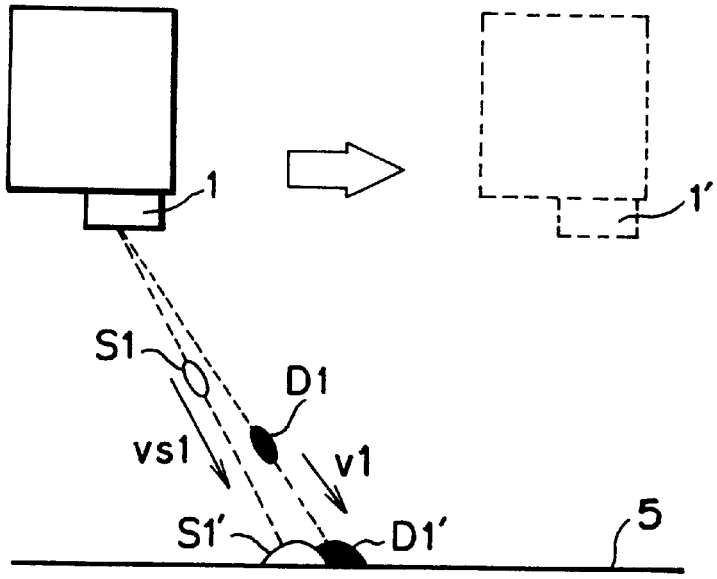
FIG. 1 is a side elevation showing a manner of printing in the first embodiment of an ink-jet printing apparatus according to the present invention.

FIG. 1 is a side elevation for explaining a printing method by an ink-jet printing head (hereinafter referred to as head) of the first embodiment of an ink-jet printing apparatus according to the present invention. Similarly to the heads shown in FIGS. 3A and 3B, the head shown in FIG. 1 is a serial printer head, in which two arrays of nozzle arrays are provided for ejecting an ink and a printing improvement liquid. Printing operation is performed by scanning the head on a printing paper 5 as a printing medium. The scanning is performed by moving reciprocally a carriage (not shown in FIG. 1) as a moving means so that the two arrays of the nozzles as an ink ejection portion and a liquid ejection portion are parallel to an upper surface of the printing paper 5.

Figure 3A:
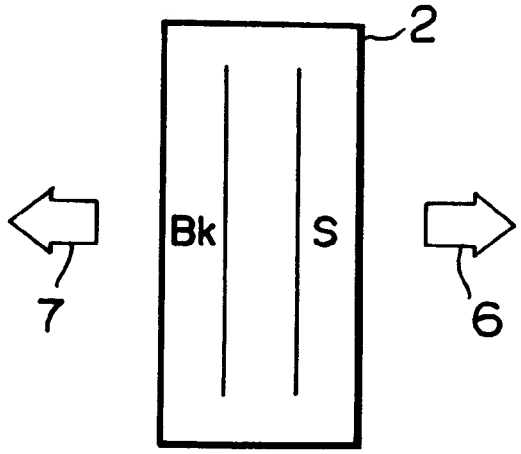
FIGS. 3A and 3B are general views illustrating a nozzle array of an ink-jet printing head employing a printing improvement liquid and a scanning direction.

In the black ink head 2 shown in FIG. 3A, there are provided a nozzle array Bk for ejecting a black ink and a nozzle S ejecting a printing improvement liquid. The color ink head 3 shown in FIG. 3B includes nozzle arrays Y, M, C for ejecting color inks of yellow, magenta and cyan and nozzle arrays S ejecting printing improvement liquids. By using these heads selectively or simultaneously, color printing can be realized.

Figure 3B:
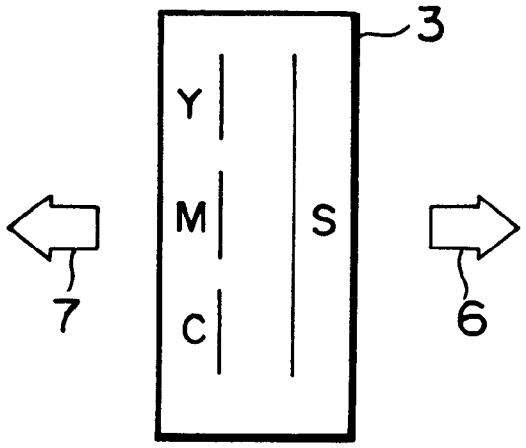

Of course, the present invention is not limited to the nozzle layout as illustrated above. On the other hand, the invention is applicable not only for the head type, in which the heads for the color inks are integrated as shown in FIG. 3B, but also for the head type, in which nozzle arrays of the color inks are provided independently of the other. Also, the dedicated head for ejecting the printing improvement liquid may be provided separately from the heads for the color inks.

In this embodiment, although the present invention is explained using a serial type printer, the present invention is not limited to the serial type printer. The present invention may be applicable to a line type printer including a head having a nozzle array extending in a width direction of a printing medium and a conveying means for conveying the printing medium.

Next, operation of the head and a printing method in this embodiment will be explained with reference to FIG. 1.

As shown in FIG. 1, the head 1 performs printing by scanning in a direction shown by an arrow up to the region of 1' with respect to the printing paper 5. When this condition is seen from a face side of the head 1, the black ink head, in which the nozzle array Bk for black ink and the nozzle array S for the printing improvement liquid are provided, is scanned in the direction of arrow 6 as shown in FIG. 3A. The printing improvement liquid contains a substance which makes a coloring agent in the ink insoluble or coagulate. Here, the coloring agent means a black color producing reagent or another color producing reagent other than the black color producing reagent. From the nozzle array S of such head, the printing improvement liquid S1 is ejected at an ejection speed vs1 to impact on the printing paper 5 to form a printing improvement liquid deposited region S1'. The head is further scanned in the direction of arrow 6. When the nozzle array Bk reaches the region where ejection by the nozzle array S was effected, black ink droplet D1 is ejected from the nozzle array Bk at an ejection speed v1 to impact on the printing paper 5 to form an ink deposited region D1' overlapping a part of the printing improvement liquid deposited region S1'.

In this embodiment, the Bk ink from the nozzle array Bk as an ink ejection portion and the printing improvement liquid from the nozzle array S as a liquid ejection portion are ejected toward the same region of the printing medium with a slight time lag so that droplets of the ink and the liquid are overlapped, and an ejection speed of the later is lower than that of the earlier. In short, the printing improvement liquid is ejected in advance of the ejection of the Bk ink. In this embodiment, both ejection of the printing improvement liquid and the ink later than the printing improvement liquid are performed in the same scanning cycle. Since the scanning speed is very high, the time lag between the ejection of the printing improvement liquid and that of the Bk ink is very slight.

This embodiment is characterized in that the ejection speed v1 of the ink ejected later than the printing improvement liquid is set to be lower than the ejection speed vs1 of the printing improvement liquid ejected earlier than the ink. By such setting, for lower ejection speed of the ink, the impact on the printing medium to sufficiently reduce rebounding of the printing improvement liquid to prevent deposition of the rebounded printing improvement liquid on the face of the head 2.

Figure 4:
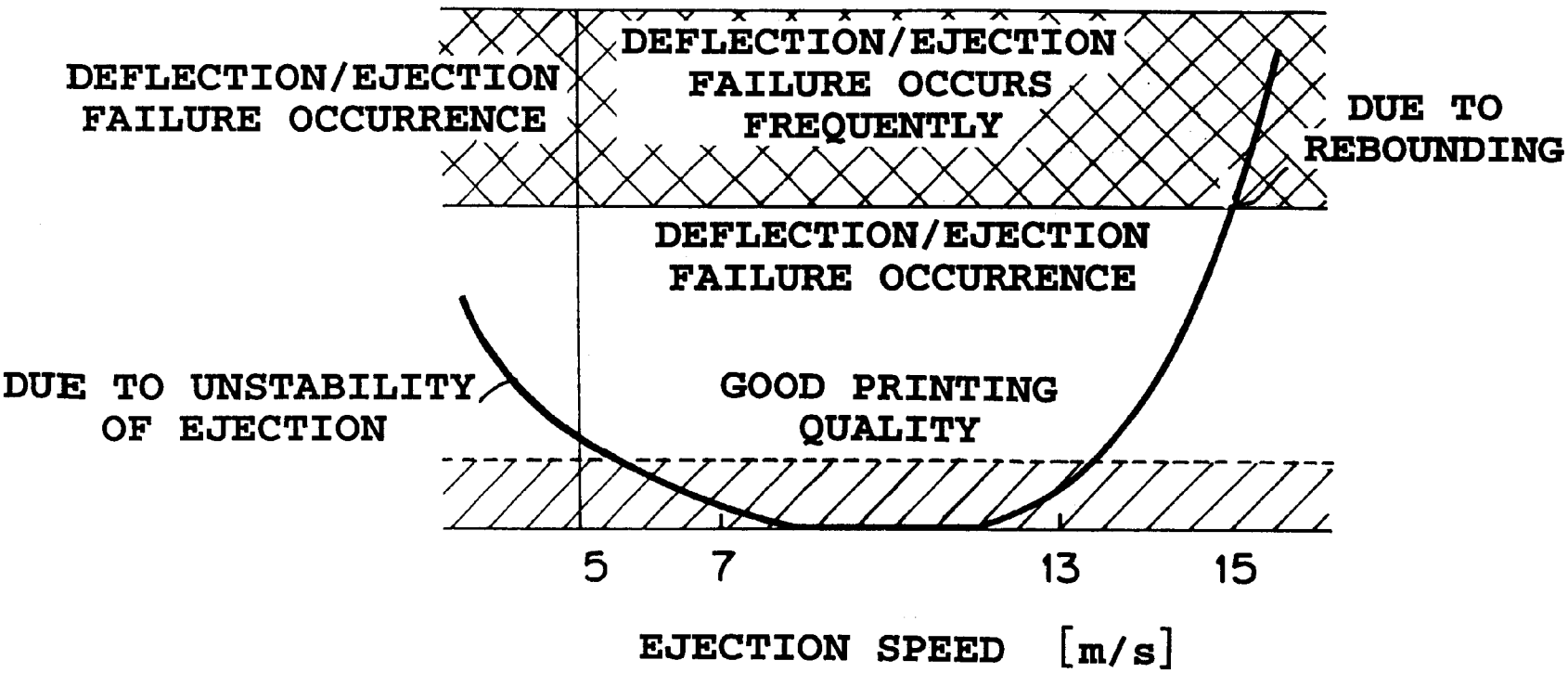
FIG. 4 is a graph showing a relationship between an ink ejection speed of the ink-jet printing apparatus employing the printing improvement liquid and occurrence of ejection failure or deflection of ejecting direction.
Figure 5:
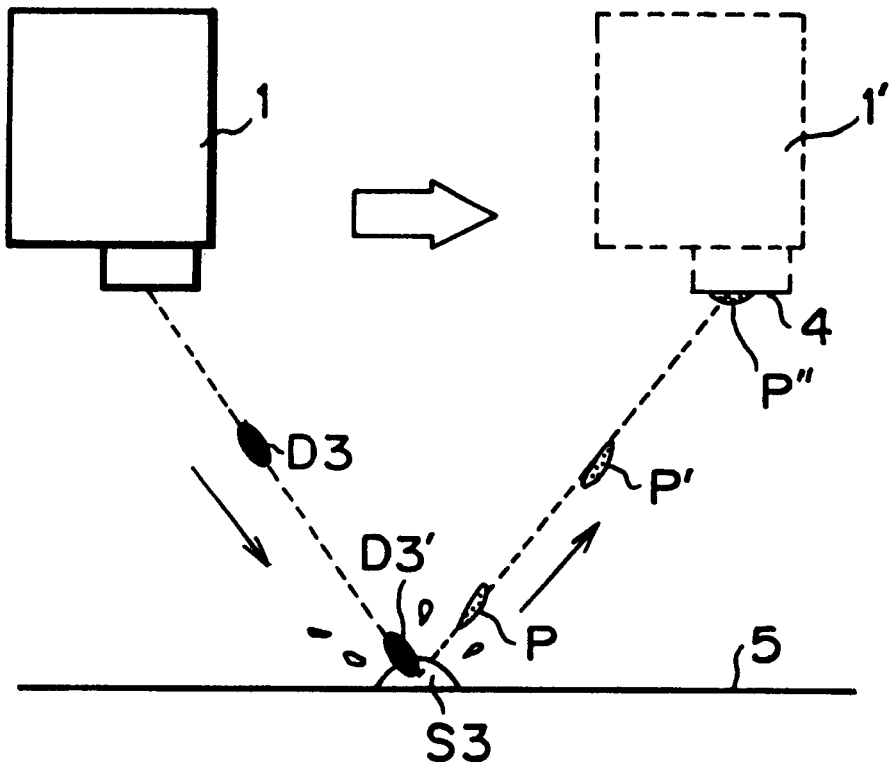
FIG. 5 is a side elevation showing a manner of printing in the conventional ink-jet printing apparatus.

FIG. 4 is a graph illustrating a relationship between the ejection speed of the ink and occurrence of deflection and/or ejection failure as results of experiments performed by the inventors. As can be clear from FIG. 4, up to about 13 m/s of the ejection speed of the ink, quality of printing is maintained in satisfactory level. When the ejection speed of the ink becomes higher, deflection of the ejecting direction and ejection failure may be caused. Furthermore, when the ejection speed of the ink becomes higher than about 15 m/s, deflection of the ejecting direction and ejection failure is frequently caused. This is because higher impact is applied to the printing improvement liquid to cause greater amount of rebounded printing improvement liquid to cause fixing of the mixture of the ink and the printing improvement liquid on the face of the head. Since such mixture is fixed on the face of the head, it becomes difficult to recover ejection performance even by performing wiping of the face by the wiper blade or the like or suction of the ink. Accordingly, it can be said that an appropriate upper limit of the ejection speed of the ink is about 13 m/s.

Conversely, it should be clear from FIG. 4 that deflection of the ejecting direction and/or ejection failure can be increased when the ejection speed of the ink is excessively low. It is considered that the excessively low ejection speed of the ink should cause degradation of stability of ejection. When the lower limit of the ejection speed of the ink is higher than or equal to 7 m/s, satisfactory printing quality can be maintained.

However, in order to achieve higher quality of the printed image or when fluctuation of ejection speed is significant, it is possible that the ejection speed of the ink has to be lower than or equal to 7 m/s. Such problem has been resolved by the following second embodiment.

Second Embodiment

Figure 2:
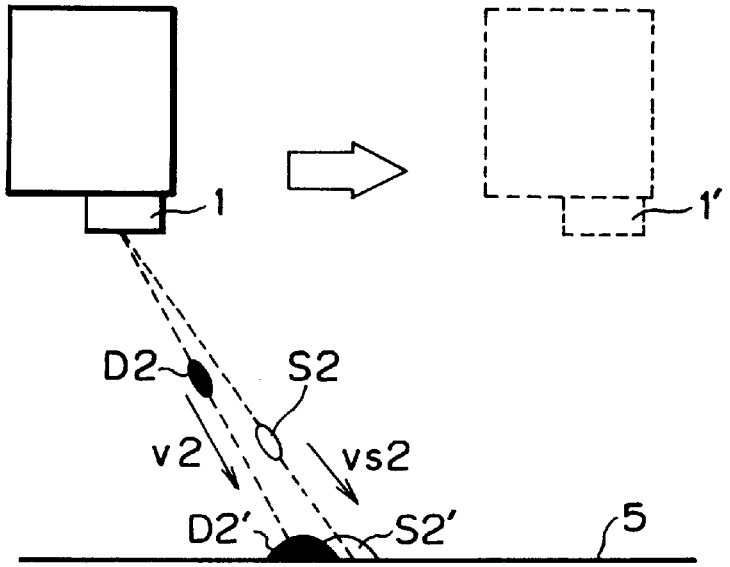
FIG. 2 is a side elevation showing a manner of printing in the second embodiment of the ink-jet printing apparatus according to the present invention.

FIG. 2 is a side elevation for explaining a printing method employing the second embodiment of an ink-jet printing head in the ink jet printing apparatus according to the present invention.

Next, operation of the head and a printing method in this embodiment will be explained with reference to FIG. 2.

As shown in FIG. 2, the head 1 performs a printing by scanning in a direction shown by an arrow up to the region of 1' with respect to the printing paper 5. When this condition is seen from a face side, the black ink head, in which the nozzle array Bk for black ink and the nozzle array S for the printing improvement liquid are provided, is scanned in the direction of arrow 7 as shown in FIG. 3A. In this scanning direction, the nozzle array Bk for the black ink in the head constructed as set forth above, ejects the ink droplet D2 at an ejection speed v2, as shown in FIG. 2 to impact on the printing paper 5 to form an ink deposited region D2'. The head is further scanned in the direction of arrow 7. When the nozzle array S reaches the region where ejection by the nozzle array Bk was effected, a droplet S2 of the printing improvement liquid is ejected from the nozzle array S at an ejection speed vs2 to impact on the printing paper 5 to form a printing improvement liquid deposited region S2' overlapping a part of the ink deposited region D2'.

In this embodiment, the ink is ejected in advance of the ejection of the printing improvement liquid. This embodiment is characterized in that the ejection speed vs1 of the printing improvement liquid ejected later is set to be lower than the ejection speed v2 of the ink ejected earlier. By such setting, for lower ejection speed of the printing improvement liquid, the impact on the printing medium sufficiently reduces rebounding of the printing improvement liquid to prevent deposition of the rebounded printing improvement liquid on the face of the head 2.

Furthermore, in comparison with the first embodiment, in this embodiment, since the printing improvement liquid is overlapped on the ink deposited on the printing paper, ink is primarily rebounded. Even if the rebounded ink is deposited on the face of the head, it may not cause fixing of the mixture on the face in comparison with the case of the rebounded printing improvement liquid. In addition, since the ejection speed of the printing improvement liquids per se is low, mist which is increased according to increasing of the ejection speed in general, can be reduced.

Also, in this embodiment, it is not necessary to lower the ejection speed of the ink ejected earlier. Therefore, stability of ejection of the ink is certainly maintained.

Furthermore, in this embodiment, the printing improvement liquid is ejected after ejection of the ink. Even in this case, when the printing improvement liquid can be impacted on the preliminary ejected ink before the ink is absorbed in the printing paper to cause admixing of both liquids, no degradation of the printing quality may be caused.

Next, a further embodiment having features of both of the former embodiments will be described.

Third Embodiment

Figure 6:
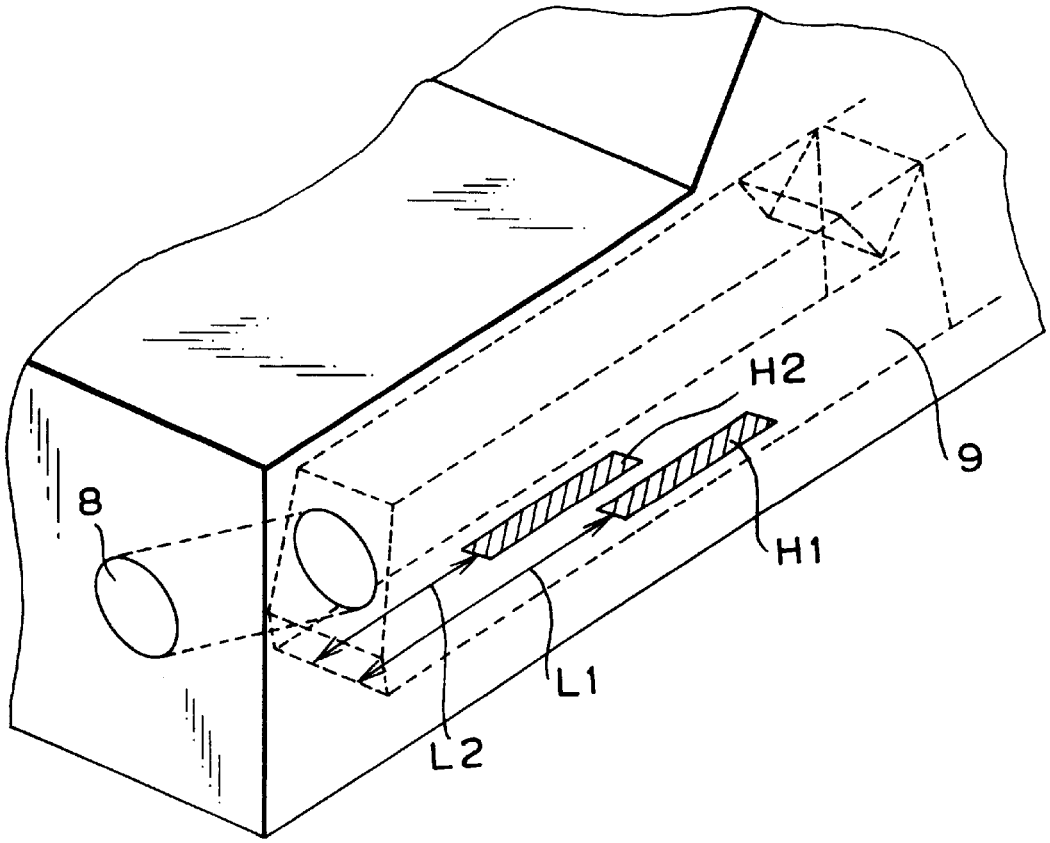
FIG. 6 is a general perspective view of the nozzle in the third embodiment of the ink-jet printing apparatus according to the present invention.

FIG. 6 is a general perspective view diagrammatically showing a structure of a nozzle in the head of the third embodiment of the ink-jet printing apparatus according to the present invention. This embodiment features in that each nozzle in the head is generally constructed with one ejection opening 8, a liquid passage 9 for supplying the ink or the printing improvement liquid toward the ejection opening 8 and two heater elements H1 and H2 as electro-thermal transducers placed at mutually different distances from the ejection opening 8. A distance L1 of the heater element H1 from the ejection opening 8 is set to be longer than the distance L2 of the heater element H2 from the ejection opening 8. Also, the heater elements H1 and H2 have the same area and are equally distanced in the aligning direction of the nozzle array.

In the head constructed as set forth above, by selectively heating the heater element H1 or H2, the ink or the printing improvement liquid may be ejected through the ejection opening. Because of different distances from the ejection opening 8 of the heater elements, the amounts of the ink or printing improvement liquid to be filled between the ejection opening 8 and the heater element H1 or H2 before heating of the ejection element are naturally different. Therefore, the ejection speed of the ink or the printing improvement liquid can be differentiated depending upon the heating element used for heating.

Figure 7:
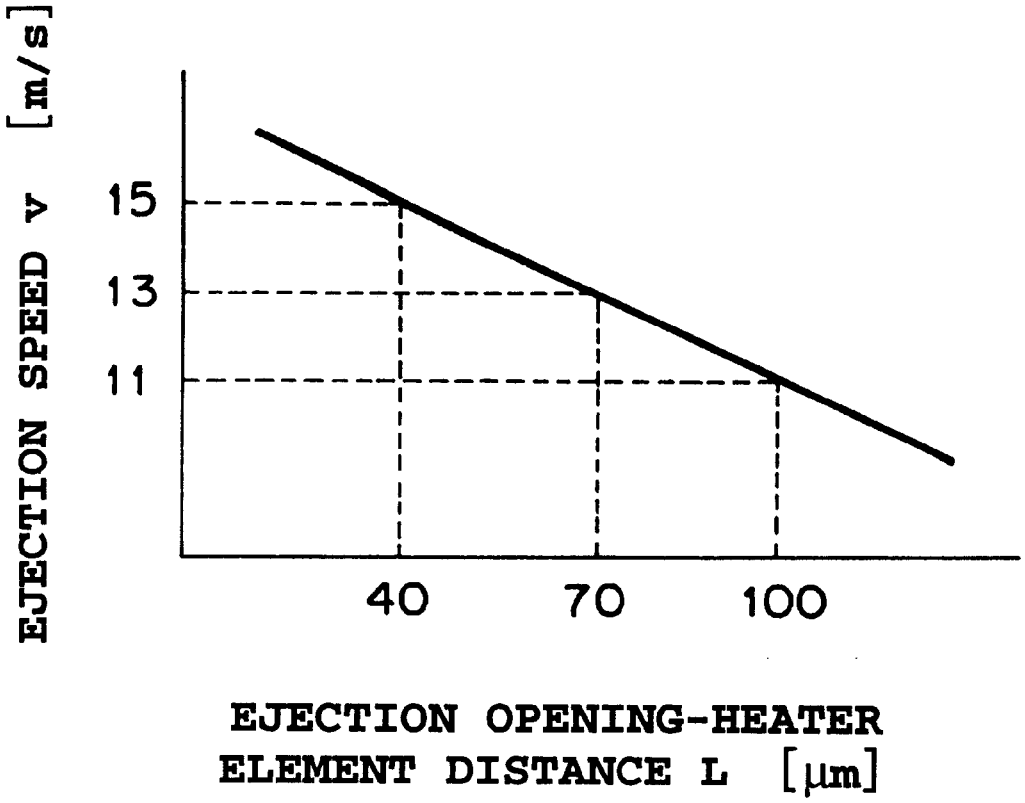
FIG. 7 is a graph showing a relationship between an OH distance in respective nozzle of the ink-jet head and the ejection speed.

FIG. 7 is a graph illustrating a relationship between a distance between the heater element and the ejection opening (hereinafter referred to as OH distance) and the ejection speed, as results of experiments obtained by employing a prototype head by the inventor. As shown in FIG. 7, it becomes apparent that the ejection speed at the OH distance 40 $\mu$m is 15 m/s, whereas the ejection speed at the OH distance 100 $\mu$m is lowered down to 11 m/s. Namely, by employing the head constructed as illustrated in FIG. 6, the ink and the printing improvement liquid may be ejected with varying the ejection speed.

The operation for performing ejection with employing the construction of the heater elements shown in FIG. 6 in both of ejection nozzles for the ink and the printing improvement liquid in this embodiment, will be explained hereinafter.

When the head 2 shown in FIG. 3A is shifted in the direction of arrow 6 (primary scanning direction), the printing improvement liquid is ejected in advance of the Bk ink. When the printing improvement liquid ejection nozzle reaches at a printing region of the printing paper 5, the heater element H2 in the printing improvement liquid ejection nozzle shown in FIG. 6 heats the liquid to eject it. Subsequently, when the Bk ink ejection nozzle reaches the printing region as described above, the heater element H1 in the ejection nozzle for performing ejection of the ink shown in FIG. 6 heats the Bk ink to eject it at an ejection speed which is lower than that of the printing improvement liquid. By employing such ejection method, it becomes possible to provide difference in the ejection speeds of the ink and the printing improvement liquid. Namely, the condition of ejection as diagrammatically shown in FIG. 1 is established to achieve the effect set forth with respect to the first embodiment.

On the other hand, when the head 2 shown in FIG. 3A is shifted in the direction of arrow 7 (primary scanning direction), the Bk ink is ejected in advance of the printing improvement liquid. When the ink ejection nozzle reaches at a printing region of the printing paper 5, the heater element H2 in the Bk ink ejection nozzle shown in FIG. 6 heat the ink to eject it. Subsequently, when the printing improvement liquid ejection nozzle reaches the printing region as described above, the heater element H1 in the printing improvement liquid ejection nozzle shown in FIG. 6 heats the printing improvement liquid to eject it at an ejection speed which is lower than ejection speed of the ink. By employing such ejection method, it becomes possible to provide difference in the ejection speeds between the ink and the printing improvement liquid in the same condition of ejection as diagrammatically shown in FIG. 2 to achieve the effect set forth with respect to the second embodiment. Namely, in comparison with the former first and second embodiments, this embodiment is directed to a serial printer which can perform reciprocal printing on the printing head, and since the ejection speed can be varied by simply selecting the heater element to be heated, printing in both directions (directions of arrows 6 and 7 in FIGS. 3A and 3B) can be performed without lowering the printing speed. Furthermore, rebounding of the printing improvement liquid may be successfully prevented. Also, the printer may become flexible in selecting operation mode, such as high speed mode by reciprocally printing, high quality mode by one way printing as desired by the user. Here, the head 3 shown in FIG. 3B can be used as well as the head 2 shown in FIG. 3A. When the head 3 is shifted in the direction of arrow 6, the printing improvement liquid is ejected in advance of the Y, M and C inks. In this case, when the printing improvement liquid ejection nozzle reaches at a printing region of the printing paper 5, the heater element H2 in the printing improvement liquid ejection nozzle shown in FIG. 6 heats the liquid to eject it. Subsequently, when the ink ejection nozzles reach the printing region as described above, the heater element H1 in the ink ejection nozzles shown in FIG. 6 heats the inks to eject them at ejection speeds which are lower than that of the printing improvement liquid.

Conversely, when the head 3 is shifted in the direction of arrow 7, the Y, M and C inks are ejected in advance of the printing improvement liquid. In this case, when the inks reach at a printing region of the printing paper 5, the heater elements H2 in the ink ejection nozzles shown in FIG. 6 heat the inks to eject them. Subsequently, when the printing improvement liquid ejection nozzle reaches the printing region as described above, the heater element H1 in the liquid ejection nozzle shown in FIG. 6 heats the liquid to eject it at ejection speed which is lower than the inks.

Figure 8:
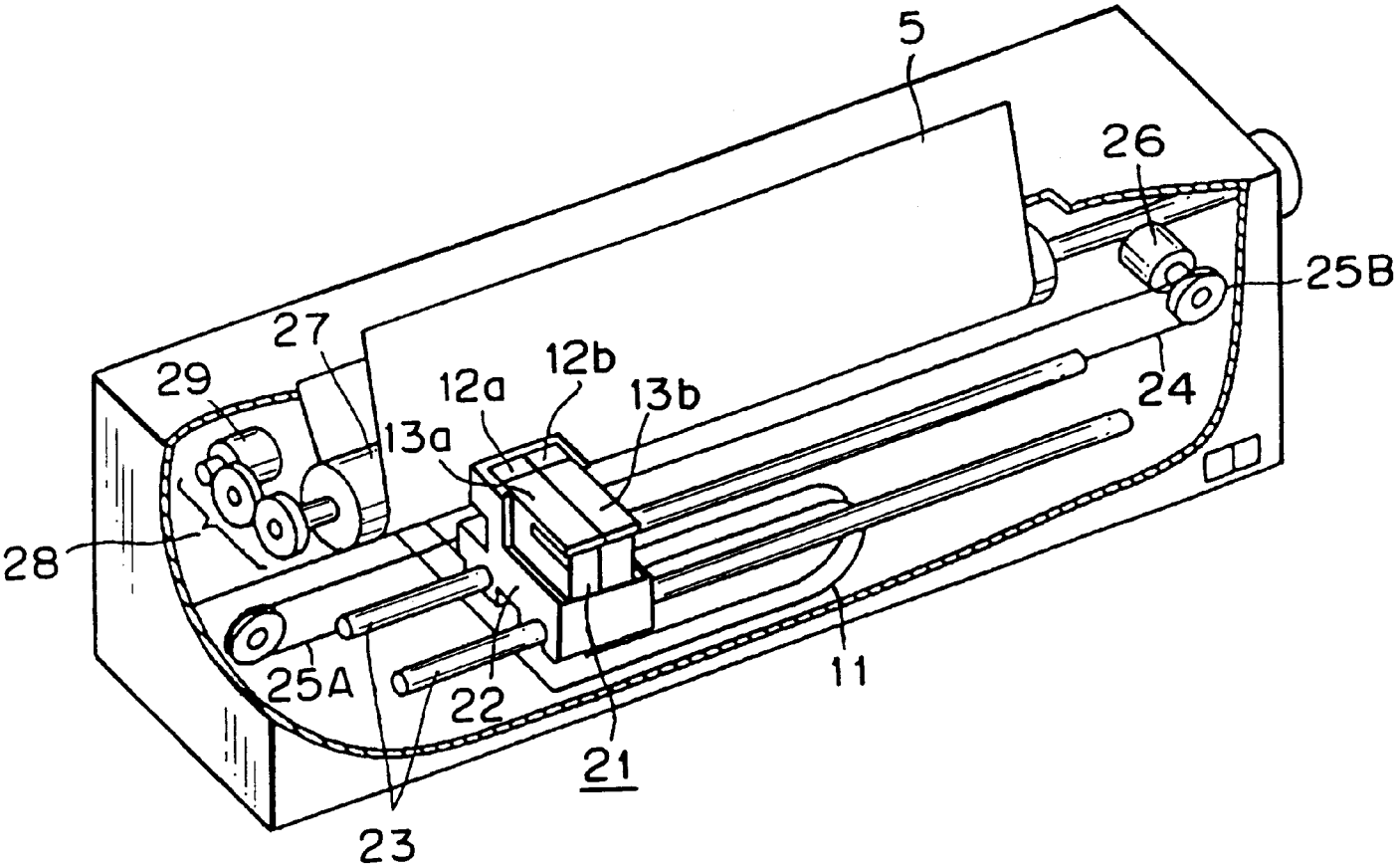
FIG. 8 is a general perspective view showing the major portion of another embodiment of the ink-jet printing apparatus which can mount the foregoing ink-jet head.

FIG. 8 is a general perspective view showing a major part of one embodiment of the ink-jet printing apparatus which can load the head constructed as shown in FIG. 3A or 3B. It should be noted that, in this embodiment, a following printing improvement liquid is employed as a liquid containing a substance which makes the coloring agent in the ink insoluble or coagulate.

The head 12 shown in FIG. 8 includes the ejection nozzle array Bk for ejecting the black ink and the ejection nozzle array S for ejecting the printing improvement liquid as shown in FIG. 3A or the ejection nozzle array Y for ejecting the yellow ink, the ejection nozzle M for ejecting the magenta ink, the ejection nozzle array C for ejecting the cyan ink and the ejection nozzle array S for ejecting the printing improvement liquid as shown in FIG. 3B.

On the other hand, the head 12 has two heater elements generating heat energy to be utilized for ejection provided in each of the ink passages corresponding to and communicating with respective ejection openings. The heater generates heat in response to an electrical pulse applied depending upon drive data and thereby causes film boiling. By film boiling, a bubble is generated to cause ejection of the ink droplet or the printing improvement liquid droplet from the ejection opening. While not illustrated, in the printing apparatus shown in FIG. 8, a suction recovery device is provided for performing suction recovery operation for the face of the head 12 mounted on a carriage 22 when the carriage 22 is shifted into a home position region. Also, a cleaning or wiping blade (not shown) is also provided for cleaning the face of the head 12.

The head 12 constructed as set forth above forms an ink-jet unit 21 together with a tank 13 storing respective colors of ink and the printing improvement liquid, as shown in FIG. 8.

The ink-jet head 21 is detachably mounted on the carriage 22. The carriage 22 is slidably engaged with two guide bars 23 and shifted as guided therealong. Shifting of the carriage 22 is performed by a driving force of a motor 26 via pulleys 25A and 25B through a belt 24, on which a part of the carriage 22 is mounted.

A flexible cable 11 is connected to each head to transmit ejection an signal and control a signal on the basis of a printing data from a host system or system control portion to a head driver circuit provided in the head.

A platen roller 27 is arranged to direct the longitudinal axis thereof to extend in parallel relationship with the guide bar 23. The platen roller 27 is rotationally driven by a paper feeding motor 29 to feed the printing paper 5 and restricts a printing surface of the printing paper 5. In the construction set forth above, the ejection opening corresponding to each color in the ink-jet unit ejects ink toward a printing surface of the printing paper, namely the portion opposing to the ejection opening according to shifting of the carriage, for performing printing.

Here, as an example, the printing improvement liquid or solution for making ink dyestuff insoluble can be obtained in the following manner.

Specifically, after the following components are mixed together and dissolved, and the mixture is pressure-filtered by using a membrane filter of 0.22 mm in pore size (tradename: fuloropore filter manufactured by Sumitomo Electric Industries, Ltd.), and thereafter, pH of the mixture is adjusted to a level of 4.8 by adding sodium hydroxide whereby liquid A1 can be obtained.

| [components of A1] | |
|---|---|
| Low molecular weight ingredients of cationic compound; | |
| Stearyl-trimethyl ammonium salts (tradename: Electrostriper QE, manufactured by Kao Corporation), or Stearyl-trimethyl ammonium chloride (tradename: Yutamine 86P, manufactured by | 2.0 parts by weight |

-continued

| [components of A1] | |
|---|---|
| Kao Corporation) | |
| High molecular weight ingredients of cationic compound; | |
| copolymer of diarylamine hydrochloride and sulfur dioxide (having an average molecular weight of 5000) (tradename: polyaminesulfon PAS-92, manufactured by Nitto Boseki Co., Ltd) | 3.0 parts by weight |
| Thiodiglycol; | 10 parts by weight |
| Water | balance |

Preferable examples of ink which becomes insoluble by mixing with the aforementioned printing improvement liquid can be noted below.

Specifically, the following components are mixed together, the resultant mixture is pressure-filtered with the use of a membrane filter of 0.22 mm in pore size (tradename: Fuloroporefilter, manufactured by Sumitomo Electric Industries, Ltd.) so that yellow ink Y1, magenta ink M1, cyan ink C1 and black ink K1 can be obtained.

| | |
|---|---|
| Y1 | |
| C. I. direct yellow 142 | 2 parts by weight |
| Thiodiglycol | 10 parts by weight |
| Acetynol EH (tradename: manufactured by Kawaken Fine Chemical Co., Ltd.) | 0.05 parts by weight |
| Water | balance |
| M1 | |
| having the same composition as that of Y1 other than that the dyestuff is changed to 2.5 parts by weight of C.I. acid red 289. | |
| C1 | |
| having the same composition as that of Y1 other than that the dyestuff is changed to 2.5 parts by weight of acid blue 9. | |
| K1 | |
| having the same composition as that of Y1 other than that the dyestuff is changed to 3 parts by weight of C.I. food black 2. | |

According to the present invention, the aforementioned printing improvement liquid and ink are mixed with each other at the same region on the printing medium or at the region where they penetrate in the printing medium. As a result, the ingredient having a low molecular weight or cationic oligomer among the cationic material contained in the printing improvement liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight or cationic oligomer are adsorbed by the ingredient having a high molecular weight contained in the printing improvement liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight or the cationic oligomer of the cationic material and the anionic dye by way of the aforementioned mechanism, has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of polymer.

By the way, the term "insoluble" or "aggregation" refers to observable events in only the above first stage or in both the first and second stages.

When the present invention is carried out, since there is no need of using the cationic material having a high molecular weight and polyvalent metallic salts like the prior art or even though there is need of using them, it is sufficient that they are assistantly used to improve an effect of the present invention, and a quantity of usage of them can be minimized. As a result, the fact that there is no reduction of a property of color exhibition that is a problem in the case that an effect of water resistibility is asked for by using the conventional cationic high molecular weight material and the polyvalent metallic salts can be noted as another effect of the present invention.

With respect to a printing medium usable for carrying out the present invention, there is no specific restriction; so called plain paper such as copying paper, bond paper or the like conventionally used can preferably be used. Of course, coated paper specially prepared for ink jet printing and OHP transparent film are preferably used. In addition, ordinary high quality paper and bright coated paper can preferably be used.

The present invention achieves distinct effect when applied to a recording head or a recording apparatus which has means for generating thermal energy such as electro-thermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electro-thermal transducers, each disposed on a sheet or liquid passage that retains liquid (ink), and operates as follows: first, one or more drive signals are applied to the electro-thermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electro-thermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electro-thermal transducers is used as ejection orifices of the electro-thermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electro-thermal transducers or a combination of other heater elements and the electro-thermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify upon impact on the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electro-thermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Figure 9:
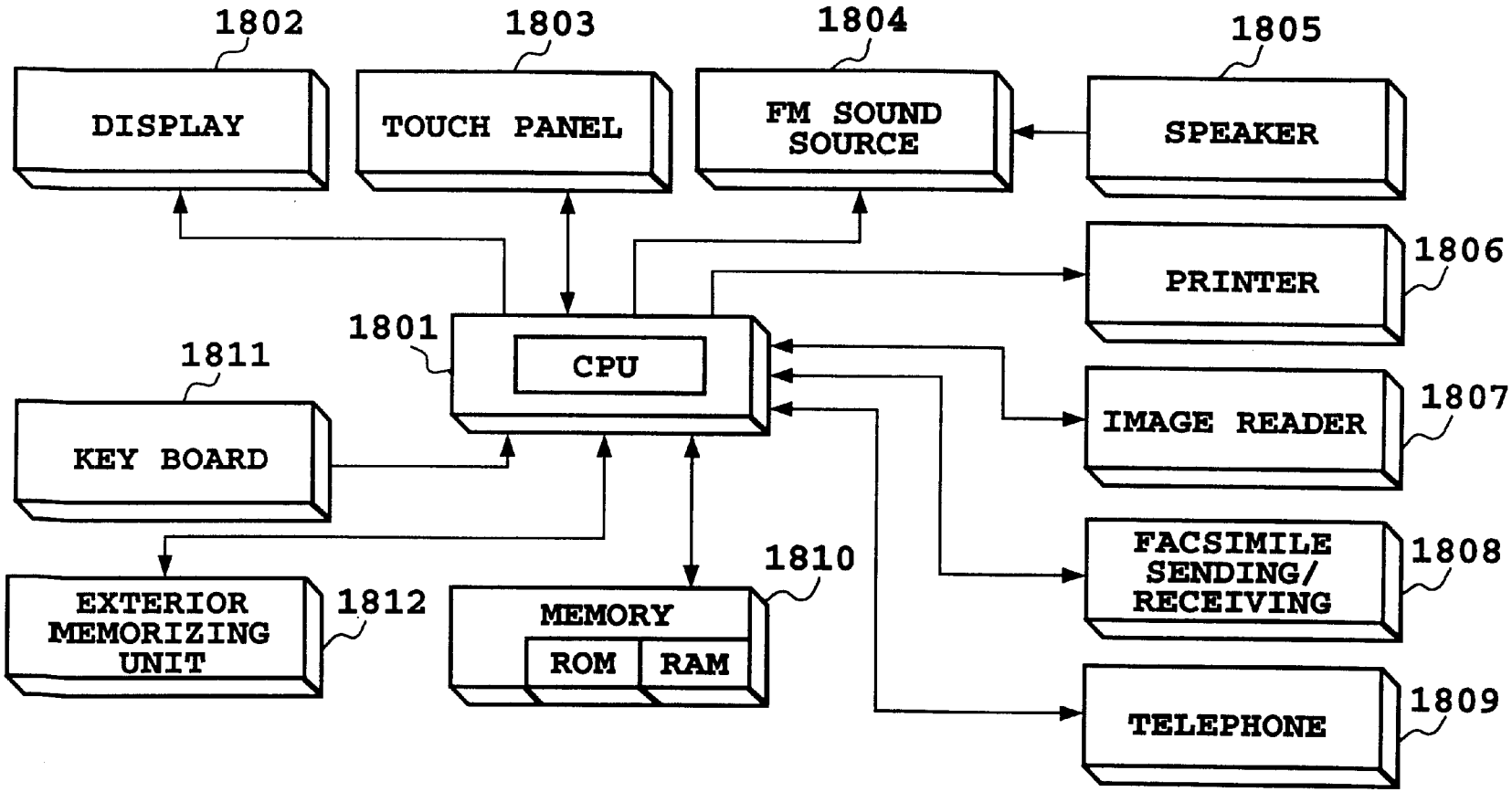
FIG. 9 is a block diagram showing a general construction in the case of application of an information processing system having a function as a word processor, a personal computer, a facsimile apparatus, a copying apparatus.

FIG. 9 is a block diagram showing general construction of an information processing apparatus having a function of word processor, personal computer, facsimile machine, a copy machine and so forth, to which the printing apparatus according to the present invention is applied.

In the drawings, a reference numeral 1801 denotes a control portion performing control of the overall apparatus, which includes CPU, such as microprocessor and so forth, and various I/O ports, to perform control for outputting control signal or data signal and so forth to respective portions and inputting control signal or data signal from the respective portions. A reference numeral 1802 denotes a display portion having a display screen, on which various menus, document information and images or so forth read by an image reader 1807 are displayed. A reference numeral 1803 denotes a transparent pressure sensitive touch panel provided on the display portion 1802 for performing item entry or coordinate portion entry on the display portion 1802 by depressing the surface thereof by a finger or so forth.

A reference numeral 1804 denotes an FM (frequency modulation) sound source portion which stores music information produced by a music editor and so forth in a memory portion 1810 or an external memory 1812 and performs FM modulation by reading out the stored music information from the memory portion or so forth. An electric signal from the FM sound source portion 1804 is transformed into an audible sound by a speaker portion 1805. A printer portion 1806 is employed as an output terminal of the word processor, the personal computer, the facsimile machine, the copy machine and so forth, in which the printing apparatus according to the present invention is applied.

A reference numeral 1807 denotes an image reader portion for optoelectrically reading out an original data for inputting, which is located at the intermediate position in an original feeding path and performs reading out various original documents, such as an original document for facsimile machine or copy machine. A reference numeral 1808 denotes a facsimile (FAX) transmission and reception portion for transmitting original data read by the image reader portion or for receiving transmitted facsimile signal, which facsimile transmission and reception portion has an external interface function. A reference numeral 1809 denotes a telephone machine portion having a normal telephone function and various associated functions, such as a recording function and so forth.

A reference numeral 1810 denotes a memory portion including a ROM storing a system program, a manager program, other application programs and so forth, as well as character fonts, dictionary and so forth, a RAM for storing application program loaded from an external storage device 1812, document information, video information and so forth.

A reference numeral 1811 denotes a keyboard portion inputting document information or various commands. A reference numeral 1812 denotes the external storage device employing a floppy disc or hard disc drive as storage medium. In the external storage device 1812, document information, music or speech information, application program of the user and so forth are stored.

Figure 10:
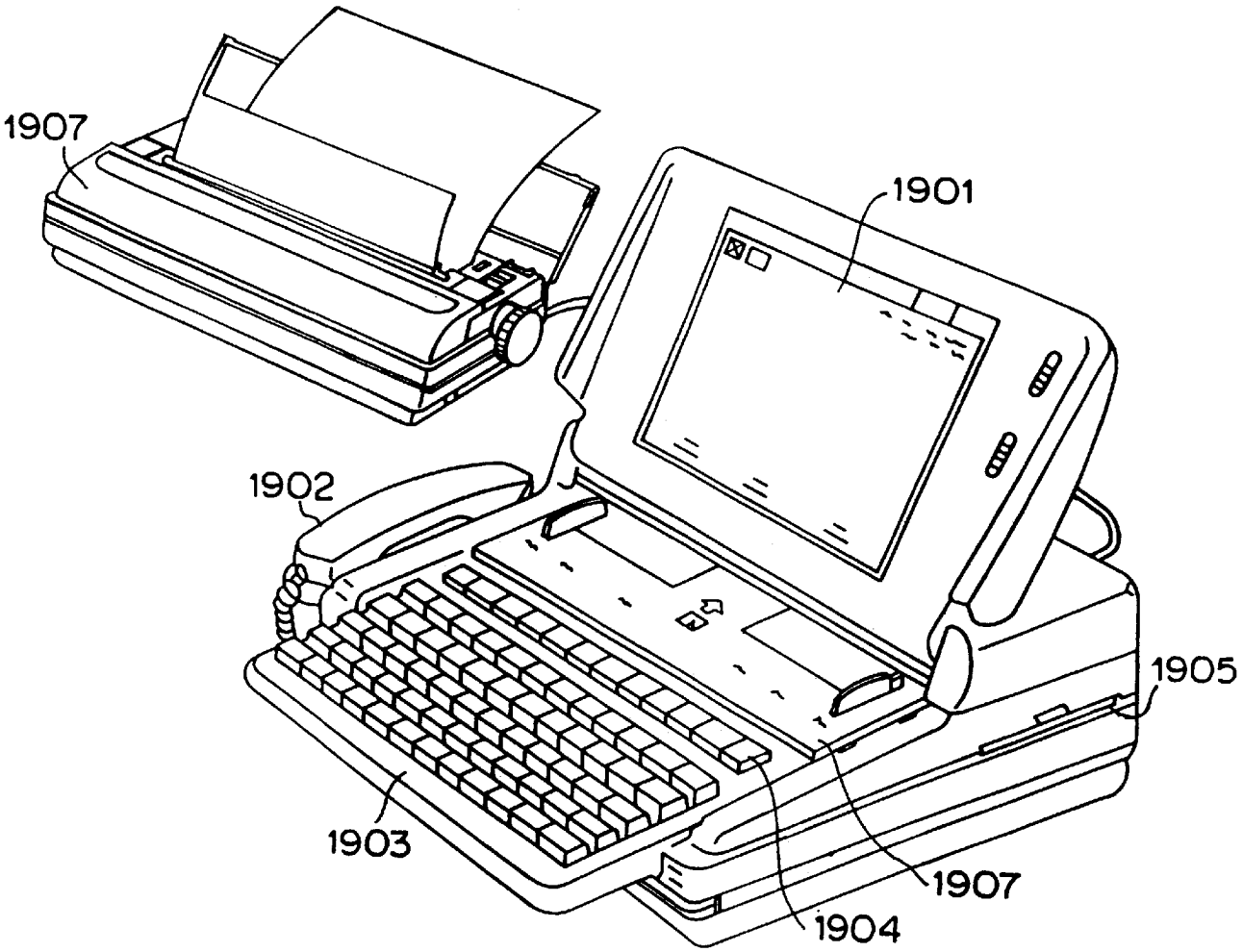
FIG. 10 is a diagrammatic external view of the information processing system shown in FIG. 9.

FIG. 10 is a diagrammatic external view of the information processing system shown in FIG. 9.

In FIG. 10, a reference numeral 1901 denotes a flat panel display utilizing a liquid crystal and so forth. On this display, the touch panel 1803 is overlaid so that coordinate position input or item designation input can be performed by depressing the surface of the touch panel 1803 by a finger or so forth. A reference numeral 1902 denotes a handset to be used when a function as the telephone machine of the apparatus is used. A keyboard is detachably connected to a main body of the apparatus through a cable and adapted to permit entry of various document information or various data input. On the other hand, on the keyboard 1903, various function keys and so forth are arranged. A reference numeral 1905 denotes an insertion mouth of the external storage device 1812 for accommodating a floppy disk inserted thereinto.

A reference numeral 1906 denotes a paper stacking portion for stacking the original to be read by the image reader portion 1807. The original read by the image reader portion is discharged from the back portion of the apparatus. On the other hand, in facsimile reception, the received information is printed by the ink-jet printer 1907.

It should be noted that while the display portion 1802 may be a CRT, it is desirable to employ a flat display panel, such as a liquid crystal display employing a ferrodielectric liquid crystal for capability of down-sizing and reduction of thickness as well as reduction of weight.

When the information processing apparatus as set forth above is operated as the personal computer or the word processor, various information input through the keyboard portion 1811 is processed according to a predetermined program by the control portion 1801 and output as printed image by the printer portion 1806.

When the information processing apparatus is operated as a receiver of the facsimile machine, facsimile information input from the FAX transmission and reception portion 1808 via a communication network is subject to reception process according to the predetermined program and output as received image by the printer portion 1808.

In addition, when the information processing apparatus is operated as a copy machine, the original is read by the image reader portion 1807 and the read original data is output to the printer portion as copy image via the control portion 1801. It should be noted that, when the information processing apparatus is used as the transmitter of the facsimile machine, the original data read by the image reader 1807 is processed for transmission according to the predetermined program by the control portion, and thereafter transmitted to the communication network via the FAX transmission and reception portion 1808.

Figure 11:
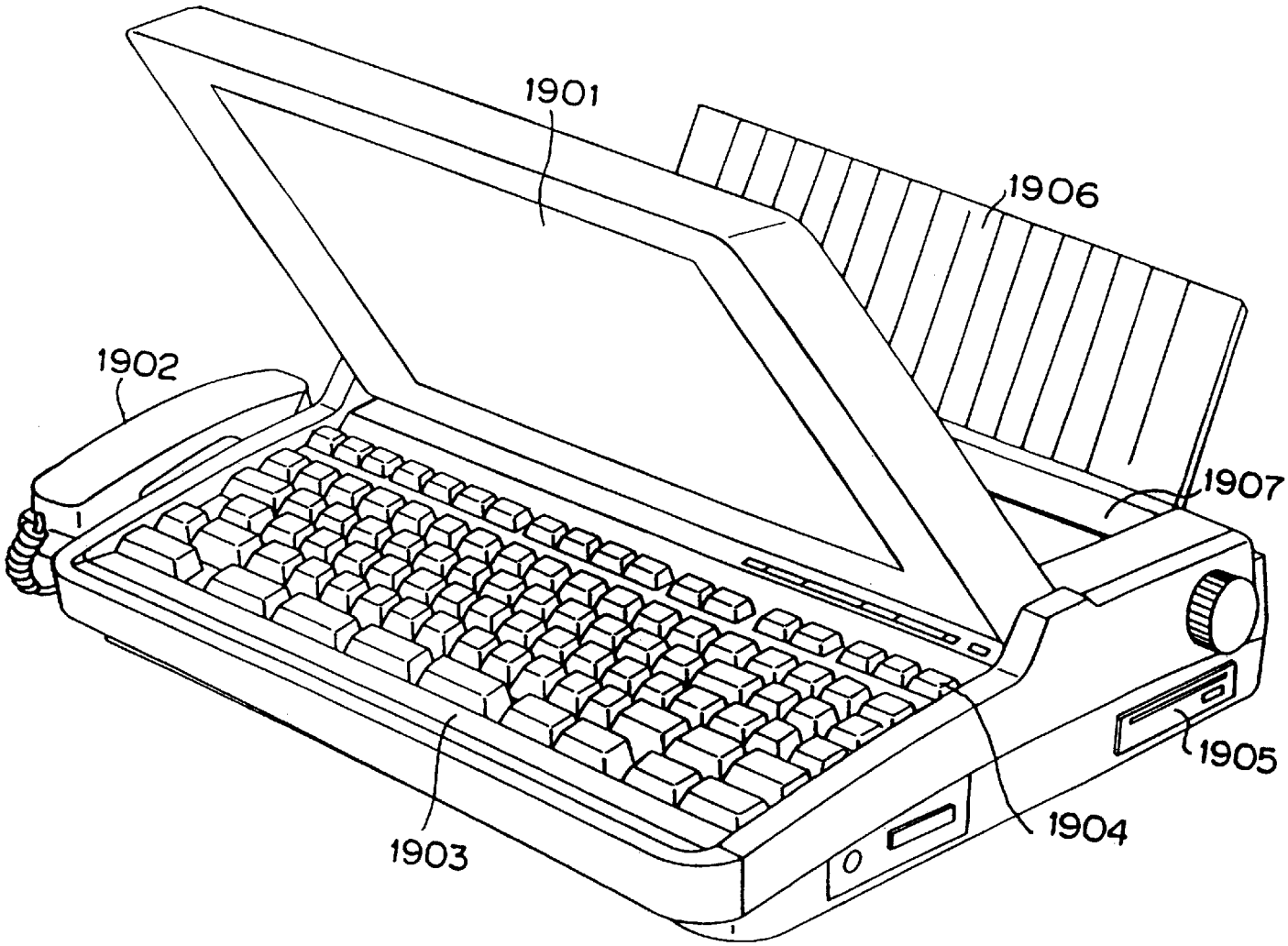
FIG. 11 is a diagrammatic external view showing one embodiment of the case where the printing apparatus according to the present invention is applied to the information processing system.

It should be noted that the information processing apparatus may be an integrated type incorporating the ink-jet printer within a main body as illustrated in FIG. 11. In this case, portability can be further improved. In FIG. 11, the portions having the same function to FIG. 10 are shown with the corresponding reference numerals.

As set forth above, a multi-function type information processing apparatus may obtain high quality printed image at high speed and low noise by employing the printing apparatus of the present invention. Therefore, the functions of the information processing apparatus can be further enhanced.

As can be clear from the description given here above, according to the present invention, by lowering the ejection speed of the ink or the printing improvement liquid ejected later, rebounding amount and mist of the printing improvement liquid can be reduced to successfully prevent the printing improvement liquid or the mixture of the printing improvement liquid and the ink from fixing on the face of the head and thus to prevent printing quality from degradation due to ejection failure and deflection of the ejecting direction. On the other hand, since deposition of the fixed ink on the face of the head will not be caused, damaging of the wiper blade for wiping the face can be certainly prevented to avoid possibility of failure of wiping of the face by the wiper blade.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus for performing printing employing an ink ejection portion including a nozzle array for ejecting an ink toward a printing medium and a liquid ejection portion including a nozzle array for ejecting a liquid containing a substance making a coloring agent in the ink insoluble or coagulate, said apparatus comprising:

means for ejecting an ink droplet from the ink ejection portion and a liquid droplet from the liquid ejection portion toward the same region of the printing medium with a slight time lag so that the ink and the liquid are overlapped; and means for controlling an ejection speed of the later ejected ink or liquid droplet to be lower than that of the earlier ejected droplet.

2. An ink-jet printing apparatus as claimed in claim 1, further comprising moving means for reciprocally scanning the ink ejection portion and the liquid ejection portion which are parallel to a surface of the printing medium.

3. An ink-jet printing apparatus as claimed in claim 2, wherein the nozzle array of the ink ejection portion extends in a direction perpendicular to a scanning direction of the ink ejection portion defined by the moving means, and wherein the nozzle array of the liquid ejection portion is parallel to the nozzle array of the ink ejection portion.

4. An ink-jet printing apparatus as claimed in claim 3, wherein the ejection of the ink and that of the liquid are performed at the same region of the printing medium during the same scanning cycle by the moving means so that droplets of the ink and the liquid are overlapped at the same region of the printing medium.

5. An ink-jet printing apparatus as claimed in claim 4, wherein the ejection speed v (m/s) of the later ejected droplet is within a range of $7<v<13$.

6. An ink-jet printing apparatus as claimed in claim 1, wherein the liquid contains cationic substances having a component of a first molecular weight and a component of a second molecular weight higher than the first molecular weight, and wherein the ink contains anionic dye.

7. An ink-jet printing apparatus as claimed in claim 1, wherein the liquid contains cationic substances having a component of a first molecular weight and a component of a second molecular weight higher than the first molecular weight, and wherein the ink contains anionic compound and pigment.

8. An ink-jet printing method of performing printing by ejecting an ink and a liquid, containing a substance making a coloring agent in the ink insoluble or coagulate, toward a printing medium, comprising the steps of:

providing an ink ejection portion including a nozzle array for ejecting the ink and a liquid ejection portion including a nozzle array for ejecting the liquid; and ejecting an ink droplet from the ink ejection portion and a liquid droplet from the liquid ejection portion toward the same region of the printing medium with a slight time lag so that the ink and the liquid are overlapped, while controlling an ejection speed of the later elected ink or liguid droplet to be lower than that of the earlier ejected droplet.

9. An ink-jet printing method as claimed in claim 8, further comprising the step of providing a moving means for reciprocally scanning the ink ejection portion and the liquid ejection portion which are parallel to a surface of the printing medium.

10. An ink-jet printing method as claimed in claim 8, wherein the nozzle array of the ink ejection portion extends in a direction perpendicular to a scanning direction of the ink ejection portion defined by the moving means, and wherein the nozzle array of the liquid ejection portion is parallel to the nozzle array of the ink ejection portion.

11. An ink-jet printing method as claimed in claim 10, wherein the ejection of the ink and that of the liquid are performed at the same region of the printing medium during the same scanning cycle by the moving means so that droplets of the ink and the liquid are overlapped at the same region of the printing medium.

12. An ink-jet printing method as claimed in claim 11, wherein the ejection speed v (m/s) of the later ejected droplet is within a range of $7<v<13$.

13. An ink-jet printing method as claimed in claim 10, wherein the liquid contains cationic substances having a component of a first molecular weight and a component of a second molecular weight higher than the first molecular weight, and wherein the ink contains anionic dye.

14. An ink-jet printing method as claimed in claim 10, wherein the liquid contains cationic substances having a component of a first molecular weight and a component of a second molecular weight higher than the first molecular weight, and wherein the ink contains anionic compound and pigment.

15. An ink-jet printing apparatus for performing printing employing an ink ejection portion including a nozzle array for ejecting an ink toward a printing medium and a liquid ejection portion including a nozzle array for ejecting a liquid containing a substance making a coloring agent in the ink insoluble or coagulate, said apparatus comprising:

first means for ejecting an ink droplet from the ink ejection portion; and second means for ejecting an liquid droplet from the liquid ejecting portion;

wherein said first and second means eject the ink droplet and the liquid droplet toward the same region of the printing medium with a slight time lag so that the ink and the liquid are overlapped, and an ejection speed of the later ejected ink or liquid droplet is relatively lower than that of the earlier ejected droplet.

16. An ink-jet printing apparatus as claimed in any one of claims 1, 3 or 15, wherein each of the nozzles in the ink ejection portion or the liquid ejection portion includes a single ejection opening for ejecting the ink or the liquid, a pair of electro-thermal transducers being arranged in a passage communicating with the ejection opening, the electro-thermal transducers being disposed at different distances from the ejection opening, wherein the ejection of the earlier ejected droplet is performed by utilizing heating of the electro-thermal transducer close to the ejection opening, and wherein the ejection of the later ejected droplet is performed by utilizing heating of the distant electro-thermal transducer.

17. An ink-jet printing apparatus as claimed in claim 6, wherein each of the electro-thermal transducers of the liquid ejection portion or the ink ejection portion generates a bubble in the liquid or the ink to eject the droplet of the liquid or the ink by utilizing expansion of the bubble.

18. An ink-jet printing method of performing printing by ejecting an ink and a liquid, containing a substance making a coloring agent in the ink insoluble or coagulate, toward a printing medium, comprising the steps of:

providing an ink ejection portion including a nozzle array for ejecting the ink and a liquid ejection portion including a nozzle array for ejecting the liquid; and ejecting an ink droplet from the ink ejection portion and a liquid droplet from the liquid ejection portion toward the same region of the printing medium with a slight time lag so that the ink and the liquid are overlapped with each other and an ejection speed of the later ejected ink or liquid droplet is relatively lower than that of the earlier ejected droplet.

19. An ink-jet printing method as claimed in any one of claims 8, 10 or 18, wherein each of the nozzles in the ink ejection portion or the liquid ejection portion includes a single ejection opening for ejecting the ink or the liquid, a pair of electro-thermal transducers being arranged in a passage communicating with the ejection opening, the electro-thermal transducers being disposed at different distances from the ejection opening, wherein the ejection of the earlier elected droplet is performed by utilizing heating of the electro-thermal transducer close to the ejection opening, and wherein the ejection of the later ejected droplet is performed by utilizing heating of the distant electro-thermal transducer.

20. An ink-jet printing method as claimed in claim 15, wherein each of the electro-thermal transducers of the liquid ejection portion or the ink ejection portion generates a bubble in the liquid or the ink to eject the droplet of the liquid or the ink by utilizing expansion of the bubble.

* * * * *

UNITED STATES PATENT AND TRADEMARK OFFICE

CERTIFICATE OF CORRECTION

PATENT NO. : 6,164,773
DATED : December 26, 2000
INVENTOR(S) : Oikawa

It is certified that error appears in the above-identified patent and that said Letters Patent is hereby corrected as shown below:

Item [56] Attorney, Agent or Firm,
"Fitzpatirck" should read -- Fitzpatrick --.

Column 1,
Line 12, "aggregation." should read -- coagulate. --.

Column 2,
Line 28, "ejection" should read -- ejected --.
Line 29, "ejected" should read -- ejection --.

Column 3,
Line 10, "coagulater," should read -- coagulate, --.

Column 4,
Line 49, "can" should read -- can be --.

Column 6,
Line 47, "to sufficiently reduce" should read -- sufficiently reduces --.

Column 10,
Line 31, "ejection an" should read -- an ejection --, and "control a" should read -- a control --.

Column 17,
Lines 46 and 51, "claim 10," should read -- claim 8, --.

UNITED STATES PATENT AND TRADEMARK OFFICE

CERTIFICATE OF CORRECTION

PATENT NO. : 6,164,773
DATED : December 26, 2000
INVENTOR(S) : Oikawa

It is certified that error appears in the above-identified patent and that said Letters Patent is hereby corrected as shown below:

Column 18,
Line 3, "an" should read -- a --.
Line 4, "portion;" should read -- portion, --.
Line 24, "claim 6," should read -- claim 16, --.
Line 56, "claim 15," should read -- claim 19, --.

Signed and Sealed this

Eighteenth Day of December, 2001

*Attest:*

*Attesting Officer*

JAMES E. ROGAN
*Director of the United States Patent and Trademark Office*